US005501413A

United States Patent [19]

Kilger et al.

[11] Patent Number: 5,501,413

[45] Date of Patent: Mar. 26, 1996

[54] METHOD AND DEVICE FOR RECOGNIZING DECOYS SERVING TO DISGUISE A TARGET WITH THE AID OF AN ACTIVE SEARCH HEAD

[75] Inventors: Fridbert Kilger; Lothar Höwer, both of Munich, Germany

[73] Assignee: Daimler-Benz Aerospace AG, Munich, Germany

[21] Appl. No.: 329,229

[22] Filed: Jan. 16, 1973

[51] Int. Cl.[6] ..... F41G 9/00

[52] U.S. Cl. ..... 244/3.15

[58] Field of Search ..... 294/3.15, 3.16, 294/3.19

[56] References Cited

U.S. PATENT DOCUMENTS 3,712,563 1/1973 Alpers ..... 244/3.17

3,724,783 4/1973 Nolan, Jr. et al. ..... 244/3.15

*Primary Examiner*—Daniel T. Pihulic

*Attorney, Agent, or Firm*—McGlew and Tuttle

[57] ABSTRACT

A guided missile is directed toward a ground level or sea level target despite the presence of laterally and vertically offset decoys by causing the missile first to "acquire" one of the target or decoys. The guidance system then directs the missile in the azimuth plane toward the acquired target while it directs the missile along a predetermined path that ends in a low level horizontal flight. A simulator simulates a flight path toward the acquired target in the elevational plane. When the simulated flight path toward the acquired target deviates from the predetermined elevational path by a preset amount, a logic system causes the missile to unlock from the target and acquire a new one. Thus the missile will ultimately only lock onto the sea level or ground level target.

12 Claims, 2 Drawing Sheets

METHOD AND DEVICE FOR RECOGNIZING DECOYS SERVING TO DISGUISE A TARGET WITH THE AID OF AN ACTIVE SEARCH HEAD

FIELD AND BACKGROUND OF THE INVENTION

The invention is directed to a method of recognizing, by means of an active search head, decoys serving to disguise a target and located in positions which are laterally and vertically offset from the target, as well as to a device for performing the method.

In accordance with methods and devices which do not belong to the state of the art, in a missile equipped with a search head, such as disclosed, for example, in U.S. Pat. No. 3,618,096, the discrimination between the target, for example a ship, and a decoy is effected, in addition to the search for the target in the azimuth plane, by continuously measuring the elevation angle between, for example, the horizontal trajectory of the missile and the line connecting the missile and the target which is actually acquired by the search head. Insofar as this angle differs from zero and, as viewed counterclockwise, becomes positive, the search is interrupted and adjusted to a new target.

In the missiles under consideration, the elevation angle is measured, for example, by radar direction finding. As it is impossible, for technical reasons, to produce a radar beam with a zero degree flare angle, and which is not desirable, either, because, in such a case, even small targets which are not to be considered would be acquired and a considerably increased ground noise would result, a sharply focused radar lobe with a certain lobe width is used for the direction finding. However, within this radar lobe, the Poynting's vectors are variable, so that, in the direction of the symmetry axis of the lobe, the sensitivity of the angle-measuring shows a maximum, with the sensitivity decreasing toward the borders of the lobe. Thus, for a target acquired at the border of the radar lobe, the signal-to-noise ratio is unfavorable. In addition, there after errors due to the reference systems of the missile, for example to the zero variations, drifts, or both of the gyroscopic devices used in the inertial system.

This is why a blur is associated with such an angle measurement, with the result that a recognition of a decoy, located laterally and vertically away from the target, is not possible before the missile is only a small distance from the decoy. For this reason, an evaluation of the "elevation criterion" by the airborne logic circuits of the missile may be effected, but, after a certain time of flight and too late for the desired purpose.

Within the range utilizable for the angle measurement, which approximately begins 4 km before the target, it would be necessary to interrupt the target homing as soon as it is found out that, up to the time, the missile has been following a decoy. After a new target search and setting of the search head upon the newly found target, the missile must be angularly accelerated transversely relative to its trajectory, in accordance with the angular deviation of the new target, in order to bring the missile back into a collision course with the target. However, in view of the fact that the decoys generally are located several hundred meters away from the true target, in most cases, the necessary transverse accelerations can no longer be imparted, so that the missile will miss the true target.

SUMMARY OF THE INVENTION

The objective of the invention is to recognize the decoys in time and definitely, that is, to discriminate between the decoy and the target in time, in order to permit an early deviation of the missile into the collision course and to maximize the probability of hitting the true target.

Accordingly, it is an objective of the invention, in maintaining the hitherto usual approach run as to the elevation and azimuth planes, to provide a method of recognizing decoys serving to disguise the target and offset horizontally and vertically relative to the target, using a search head. In the method, the measured displacement in the elevation plane of the target momentarily acquired by the search head is evaluated, so as to permit definite discrimination between the target and the decoy within a very short time and also at a great distance of the missile from the target.

For a method of the kind mentioned above and using a missile with a stabilized roll position approaching at a predetermined altitude and guided toward the target in conformance with a method of active homing guidance, the problem is solved, in accordance with the invention, in that a simulated elevation signal for the missile is produced in the elevation plane with the aid of an additional method of active homing guidance. The simulated elevation signal is compared with an altitude signal derived from the predetermined altitude as increased by a constant value. The homing guidance in the azimuth plane, controlling the missile to follow the initially picked-up target, is interrupted and the missile is set upon a new target to be followed as soon as the simulated elevation signal has a magnitude greater than the derived signal.

The simple angle measuring of the known method, which is based on an unfiltered signal containing much more noise than intelligence owing to the mentioned errors of the system, is replaced by the invention method of homing guidance in the elevation plane, in which the signal received by the search head in the elevation plane is first filtered and thereafter treated in accordance with a guidance principle underlying the method of homing guidance. Because, in this case, the above-mentioned errors due to the reference systems of the missile are separated from the signal, the lack of definition in the identification of decoys is avoided.

Nevertheless, the elevation signal which simulates, to the missile, a change of its trajectory in a direction corresponding to the acquired target, does not interfere with the guidance control proper, so that, as before, the missile continues to follow its trajectory at the predetermined altitude. However, the simulated signal is compared with an altitude signal which is derived from the predetermined altitude as increased by a constant value. If, at a given time, the simulated elevation signal exceeds the derived altitude signal, the meaning thereof is that the target actually acquired by the search head of the missile is positioned beyond a certain zone above the azimuth plane and wherein a true target can no more be located. Thus, the mentioned criterion assures that the actually acquired target is a decoy, and that homing on this actually acquired target must be interrupted.

Moreover, because the missile is pursuing its trajectory at the predetermined altitude with only small deviations due to aerodynamic disturbing forces, it is possible considerably to reduce the constant value by which the determined altitude is increased for evaluation of the mentioned criterion. It therefore follows that, as compared with the distance between the missile and target, the flight distance to be covered by the missile between the simulated change of elevation and the point of intersection of the thus-simulated trajectory and the predetermined altitude, as increased by a constant value, is very small. Consequently, it is possible to recognize the decoy very quickly and, as follows from the foregoing, also at a great distance from the target.

Although it is possible to produce the elevation signal, as in the azimuth plane, as a simulated guidance command for the control elements of the missile, it has been proven useful and advantageous to indicate the simulated elevation signal as an altitude above ground, and to compare it with the predetermined altitude as increased by a constant value.

It is further preferable to produce the simulated elevation signal in accordance with a method of proportional navigation because, in such a case, ground noise may be filtered from the signal furnished by the search head in an advantageous manner. Also, the method of proportional navigation needs no additional treating of the starting conditions for the measured target distance in which new intrinsical errors, for example of the inertial system, would be introduced.

In accordance with a further feature of the invention, the simulated elevation signal is produced, analogously to the guiding signal, in the azimuth plane, so that, in this plane, the missile is guided in conformity with a method of proportional navigation and, in the elevation plane, an altitude signal is simulated thereto and which is derived according to the same method.

To perform the method of the invention, there is provided, in accordance with the invention, a device for recognizing decoys or dupers serving to disguise a target and located at positions offset laterally and vertically from the target, with the aid of an active search head measuring the elevation and azimuth distance from the target and homed on. This apparatus, when using a missile with a stabilized roll position homing on the target along a predetermined flight path maintained by means of an altitude controller, and equipped with a yaw circuit evaluating the output signals of the search head in accordance with a principle of guiding in the azimuth plane, is characterized in that a further elevation circuit is provided. This further elevation circuit, in order to produce a simulated elevation signal in the elevation plane and in accordance with a guidance principle, evaluates the output signals of the search head associated to a perceived target, but does not interfere with the guidance of the missile. In addition, a comparator is provided and compares the simulated elevation signal with an altitude signal derived from the predetermined altitude, as increased by a constant value, and causes interruption of the target homing, in the azimuth plane, and picking up of a new target, as soon as the simulated elevation signal exceeds the derived signal. In this case, it is also preferable that the simulated signal is an altitude relative to ground.

From the standpoint of the entire guidance equipment of the missile, it is advantageous to provide an analogous construction of the additional elevation circuit and of the yaw circuit. Inasmuch as the yaw circuit operates in conformity with a method of proportional navigation, the additional elevation circuit, in accordance with the preferred embodiment of the invention, comprises elements for producing elevation signals in conformity with a method of proportional navigation.

An object of the invention is to provide an improved method and device for recognizing, by means of an active search head, decoys or dupers serving to disguise a target and positioned in laterally and vertically offset relation to the target.

Another object of the invention is to provide such a method and device for recognizing the decoys in time and definitely.

A further object of the invention is to provide such a method and device which discriminates between the decoy and the target in time permitting an early deviation of the missile into the collision course and maximizing the probability of hitting the true target.

For an understanding of the principles of the invention, reference is made to the following description of a typical embodiment thereof as illustrated in the accompanying drawings.

DESCRIPTION OF THE PREFERRED EMBODIMENT

In the particular example chosen for illustration, it is assumed that the missile is guided in the azimuth plane in accordance with a method of proportional navigation where only small transverse accelerations are to be imparted to the missile in the proximity of the target and thus the probability of hitting the target is increased.

Figures 1A, 1B:
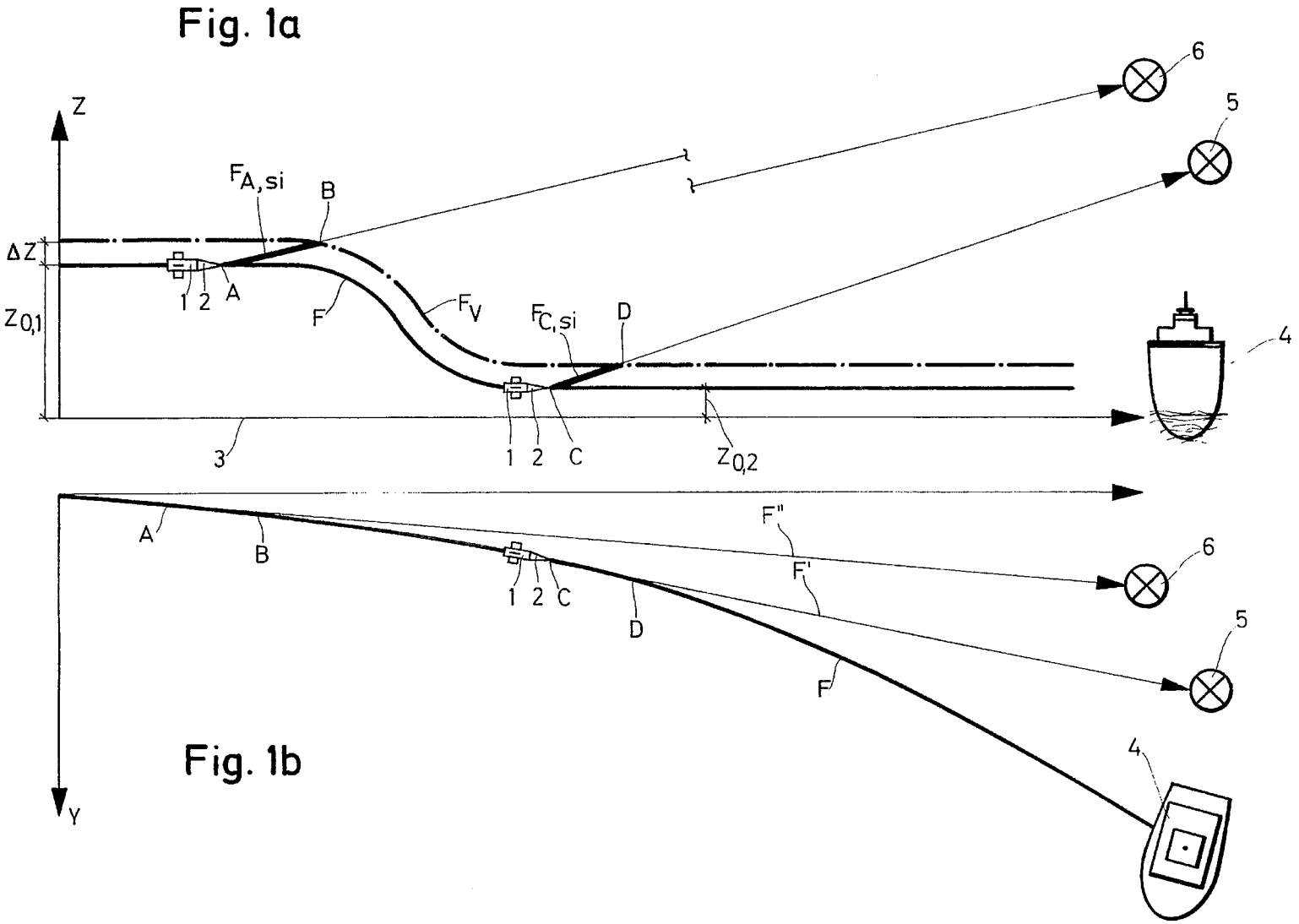
FIGS. 1*a* and 1*b* are, respectively, therefor diagrammatic lateral and top plan representations of a target homing flight of a missile, but not in correct scale, illustrating the invention method of recognizing decoys serving to disguise a target and located laterally and vertically offset from the target, from a missile stabilized in the roll position and provided with a search head.

Referring to FIGS. 1*a* and 1*b*, above the sea level 3, a missile 1 having an active search head 2 is homing on a target 4, in this case a ship, along the predetermined flight path F. As shown in these figures, at a maximum distance from the target 4, the trajectory of the missile is provided at a predetermined altitude $Z_{0.1}$ and then is deviated into a lower level $Z_{0.2}$. It is assumed that decoys, so-called dupers 5 and 6, are located in positions laterally and vertically offset from the ship 4, these decoys serving to reflect the radar beam emitted by search head 2 from missile 1. The purpose of decoys 5 and 6 is to divert the missile from its path F in the azimuth plane, as viewed in FIG. 1*b*, to the trajectories F' or F" and which would lead to a collision with the decoys 5 or 6 but not a collision with the target proper 4.

Figure 2:
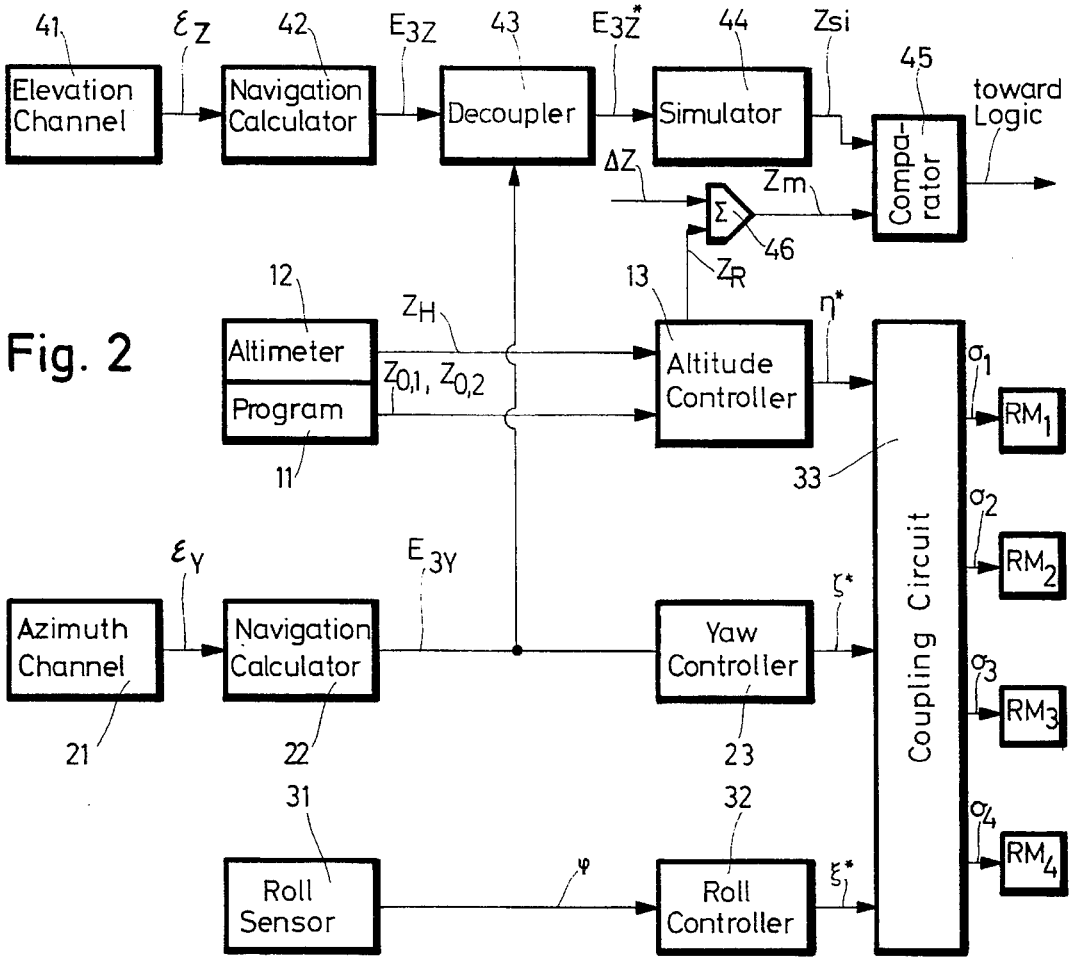
FIG. 2 is a block diagram of the target searching equipment of a missile having a device for recognizing decoys serving to disguise a target, in accordance with the invention.

The guidance of missile 1, in azimuth and in elevation, will be described with reference to FIG. 2. Referring to FIG. 2, in a program circuit 11, the two predetermined levels of the missile trajectory are stored as the constants $Z_{0.1}$ and $Z_{0.2}$. In addition, the real altitude of the missile above sea level is permanently or constantly measured by means of an altimeter 12. The output signal $Z_H$ of altimeter 12 is supplied, together with the output signal of program circuit 11, to an altitude controller 13 wherein the input signals are combined with reference signals $Z_R$ furnished by an inertia chain, so as to produce a guidance command $\eta^*$, according to a function $H(Z_{0.1}, Z_{0.2}\ Z_H)$.

To guide missile 1 in the azimuth plane Y, search head 2 constantly emits the focused radar beam toward an elected target, in this case toward either ship 4 or one of the decoys 5 or 6. In, an azimuth channel 21 of search head 2, the measured off-position of the perceived target is transformed into an angular velocity signal$\epsilon_Y$ and, in a navigation calculator 22, with further parameters which are not interesting in this connection, this signal is combined in accordance with a guidance principle $f(\epsilon_{Y\ldots})$ to an acceleration signal $E_{3Y}$. Thereby, in the azimuth plane, the missile is guided in conformity with a method of proportional navigation. The signal $E_{3Y}$ is supplied to a yaw controller 23 and there combined into a guidance command $\zeta^*$.

To stabilize the roll position of the missile, a roll sensor 31 supplies the instantaneous angular position $\phi$ of missile 1, relative to the longitudinal axis thereof, to a roll controller 32 which produces a guide command $\xi$ according to the function $R(\phi)$.

In a coupling circuit 33, the three guide commands $\eta^*$, $\xi^*$, $\xi^*$ are transformed into regulating commands $\zeta_1$, $\zeta_2$, $\zeta_3$ and $\zeta_4$ for four steering motors $RM_1$, $RM_2$ , $RM_3$ and $RM_4$. It should be noted, in this connection, that the feedbacks to the pitch controller, the yaw controller and the roll controller necessary for guidance of missile 1, are not shown in FIG. 2.

In order to discriminate the true target 4 from the decoys 5 and 6 in sufficient time, an angular speed signal $\epsilon_Z$ is formed in an elevation channel 41, for the elevation plane Z and which is analogous to the azimuth channel 21 of the search head 2. In a further navigation calculator 42, which is analogous to the navigation calculator 22, this angular speed signal is transformed into an acceleration signal $E_{3Z}$, in accordance with a guiding principle $f(\epsilon_{Z\ldots})$ and taking into account parameters which are of no interest in this connection either. Inasmuch as, for reasons of the construction of the search head, this signal $E_{3Z}$ is still combined with the signal $E_{3Y}$, as indicated by the symbol $E_{3Z}\times E_{3Y}$, these two signals are decoupled in a decoupler 43, so that only an acceleration signal $E_{3Z}^*$ appears at the output of decoupler 43. This acceleration signal depends on the elevation coordinate Z as well as on other parameters which are not interesting in this connection. The signal $E_{3Z}$ also is derived, from the measuring signal of search head 2, in accordance with a method of proportional navigation.

In an elevation circuit simulator 44, acceleration signal $E_{3Z}^*$ is transformed according to a function $H(E_{3Z}^*)$ into an elevation signal $Z_{si}$ and, advantageously, this signal indicates directly an altitude above the sea level which, however, is simulated as it will be explained later on in describing the method of operation. In the elevation circuit, the feedbacks, for example from the output of simulator 44 to the input of navigation calculator 42, are not shown in FIG. 2.

Elevation signal $Z_{si}$ is introduced into a comparator 45 on whose other input a further altitude signal $Z_m$ is applied. Signal $Z_m$ is the sum formed in a summation unit 46, of a reference signal $Z_R$, derived from the inertia chain of the altitude controller 13 and corresponding to the predetermined altitude $Z_{0.1}$ or $Z_{0.2}$, respectively, and of a magnitude corresponding to a constant value $\Delta Z$. The output signal of comparator 45, in which the difference $(Z_m-Z_{si})$ is produced, is applied to a logical circuit of the missile which logical circuit has not been shown. Such comparators are described, for example, in U.S. Pat. No. 3,046,676, referring particularly to FIG. 7 thereof.

The device as described above operates in a manner which will now be explained. Referring again to FIGS. 1*a* and 1*b*, it is assumed that, at the point A of flight path F, missile 1 has adjusted itself, with the aid of a search head 2, to a decoy 6 and, as seen in the azimuth plane, it will be assumed to follow a trajectory F". At this time, in the manner described above, an elevation signal $Z_{si}$ is produced in the altitude circuit 41, 42, 43, 44, and corresponds to the off-position of decoy 6 as measured by search head 2 of missile 1 according to the method of proportional navigation.Should this elevation signal interfere with the guidance of the missile, missile 1 will be diverted, in the elevation plane, from its trajectory at the predetermined level $Z_{0.1}$ to a new trajectory $F_{A,si}$, which would lead to a collision with perceived decoy 6. However, because the elevation signal $Z_{si}$ does not interfere with the guidance of the missile, the missile maintains its flight path F at the predetermined level.

Nevertheless, in comparator 45, the simulated trajectory $F_{A,si}$ continues to be compared with a fictional flight path $F_V$ which is offset in height by the value $\Delta Z$ with respect to the flight path F having the predetermined altitude $Z_{0.1}$. As soon as both simulated flight paths $F_{A,si}$ and $F_V$ intersect at the point B, the difference $Z_m-Z_{si}$ is evaluated in comparator 45 as being equal to 0. At this instant, comparator 45 emits an output signal to the logical circuit of the missile which, in turn, gives an instruction to the search head to interrupt the actual homing operation and to search for a new target.

If, for example at the point C, search head 2 of missile 1 adjusts itself be a new target, in the present example to the other decoy 5, the altitude circuit 41, 42, 43 44 of the search head again calculates a simulated flight path $F_{C,si}$ in the described manner. As soon as this simulated flight path, $F_{C,si}$ intersects with the fictional flight path $F_V$ at the point D, target homing is interrupted again. Thereupon, the search head adjusts itself to a new target, in the illustrated example to the true target 4, and persues the same at the predetermined altitude level $Z_{0.2}$ up to the collision and in accordance with the method of proportional navigation formed in the yaw circuit 21, 22, 23.

Figure 3:
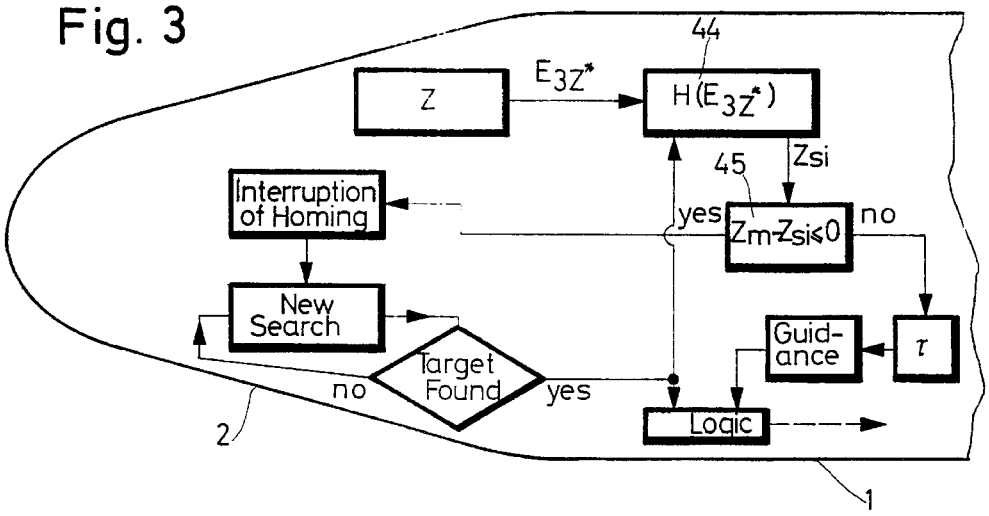
FIG. 3 is a logical diagram illustrating the operations involved in the inventive method.

To further clarify the method, the homing operation as explained again with respect to FIG. 3 illustrating a logical diagram. In the additional altitude circuit designated only by Z and comprising the units 41, 42 and 43, an acceleration signal $E_{3Z}$ * is derived from the off-position of the perceived target in accordance with the method of proportional navigation, and is transformed into an elevation signal $Z_{si}$ in elevation circuit simulator 44.

In comparator 45, this signal is compared with the altitude $Z_R$ as increased by the value $\Delta Z$. If the simulated elevation is smaller, the logical circuit of the missile decides that, after a time delay, the guidance of the missile will be maintained toward the perceived target. On the contrary, if the simulated elevation becomes greater than the derived altitude $Z_m$, the actual homing will be interrupted and an instruction will be given to search head 2 to search for a new target until such a new target is acquired. The logical circuit of the missile then is adjusted to the new target and the missile is brought into the trajectory necessary for collision with the new target.

It will be clear from the foregoing explanation that the method and device for recognizing decoys serving to disguise a target, in accordance with the invention, permits discriminating between decoys and a true target already at great distances and in sufficient time. At such great distances, only small transverse angular accelerations are necessary to bring the missile into a new trajectory leading to a collision with the new target so that the hitting probability is maximized.

While a specific embodiment of the invention has been shown and described in detail to illustrate the application of the principles of the invention, it will be understood that the invention may be embodied otherwise without departing from such principles.

What is claimed is:

1. A method of recognizing decoy targets serving to disguise a selected target and located at positions separated laterally and vertically from the selected target, using an active search head on a roll-stabilized missile homing on an acquired one of the targets along a flight path at a predetermined altitude, comprising producing a simulated elevation signal ahead of the missile in the elevation plane of the missile toward the acquired target; deriving from the predetermined altitude as increased by a constant value, an altitude signal, comparing the simulated elevation signal with the derived altitude signal; and, responsive to the simulated elevation signal exceeding the derived altitude signal, interrupting the homing guidance of the missile toward the hitherto acquired target, in the azimuth plane.

2. A method of recognizing decoys, as claimed in claim 1, in which said simulated signal is produced as an altitude above ground level, and compared with the derived altitude signal corresponding to the predetermined altitude as increased by a constant value.

3. A method of recognizing decoys, as claimed in claim 1, in which the simulated elevation signal is formed analogously to a guide signal in the azimuth plane.

4. A method of recognizing decoys, as claimed in claim 1, in which the simulated elevation signal is formed in accordance with a technique of proportional navigation.

5. A device for recognizing decoy targets serving to disguise a selected target and located at positions separated laterally and vertically from the selected target, using an active search head measuring the off-position of the target in elevation and azimuth, in a roll-stabilized missile homing on a perceived target along a flight path at a predetermined altitude, said device comprising, means stabilizing the roll position of said missile; an altitude controller maintaining the predetermined altitude of said missile; a yaw circuit evaluating the output signals of said search head in the azimuth plane, to guide the missile in the azimuth plane; an additional elevation circuit evaluating the output signals of said search head associated with the perceived target as a function of angular deviations in the elevation plane, and forming a simulated elevation signal which does not immediately affect guidance of the missile; means deriving an altitude signal corresponding to said predetermined altitude increased by a constant value; and a comparator comparing said simulated elevation signal with said derived altitude signal and, responsive to the simulated elevation signal exceeding the derived altitude signal, interrupting the guidance of the missile toward the hitherto perceived target in the azimuth plane and causing adjusting of said active search head to a new target.

6. A device for recognizing decoys, as claimed in claim 5, in which elevation circuit forms said simulated elevation signal as an altitude above sea level.

7. A device for recognizing decoys, as claimed in claim 5, in which said additional elevation circuit is constructed analogously to said yaw circuit.

8. A device for recognizing decoys, as claimed in claim 5, in which said additional elevation circuit includes proportional navigation units producing said simulated elevation signal.

9. A method for recognizing decoys posing as targets laterally and vertically offset relative to a desired target from a flying body carrying an active search head, comprising transmitting electromagnetic radiation from the search head onto one of the targets, determining from the signals reflected by the one target the deviation of the missile heading from the one target in azimuth and elevation, generating output signals which correspond to the azimuth and elevation deviations, forming azimuth guidance signals from the output signals which correspond to the azimuth deviation of the target, controlling the missile with the azimuth guidance signals so it flies on a predetermined constant level above ground toward the one target along a horizontal direction, simulating a guidance signal for the missile from the output signals indicating the elevation deviation of the one target while nevertheless maintaining the predetermined elevation, calculating a hypothetical course of the missile in the elevation plane toward the one target with the elevation guidance signal, and discontinuing setting of the search head of the missile onto the one target as soon as the simulated course of the missile in the elevation plane exceeds the predetermined flying level by a predetermined constant amount, and thereafter setting the search head to acquire a new target.

10. A device for recognizing decoy targets serving to disguise a selected target and located at positions separated laterally and vertically from the selected target, using an active search head measuring the off-position of the target in elevation and azimuth, in a roll-stabilized missile homing on a perceived target along a flight path at a predetermined altitude, said device comprising, means stabilizing the roll position of said missile; an altitude controller maintaining the predetermined altitude of said missile; a yaw circuit for forming guidance signals for the missile in the azimuth plane, said guidance signals being formed from the output signals of the search head, said guidance signals guiding the flying body onto a collision course in the azimuth direction toward the one target; an additional elevation circuit for simulating a guidance signal without affecting the altitude of the-missile; means deriving an altitude signal corresponding to said predetermined altitude increased by a constant value; and a comparator for comparing said simulated elevation signal with said derived altitude signal and, responsive to the simulated elevation signal exceeding the derived altitude signal, for interrupting the guidance of the missile toward the hitherto perceived target in the azimuth plane and causing adjustment of said active search head to a new target.

11. A missile guidance system for guiding a missile toward a ground level or sea level target lower than and laterally offset from decoys posing as targets, comprising searching means mounted on the missile for causing the missile to acquire one of the true or posed targets and produce azimuth and elevation guidance signals, azimuth guidance means, elevational guidance means, simulating means, and logic means, characterized in that said azimuth guidance means guides the missile in response to the azimuth signals toward the acquired target while the elevational guidance means guides the missile along a predetermined path terminating in a horizontal movement toward the ground or sea level target and said simulation means simulates the missile flight path toward the acquired target while said logic means causes said searching means to seek a new target if the simulated path departs from the predetermined elevational path by more than a predetermined amount.

12. The method of guiding a missile toward a sea level or ground level target in the presence of laterally and vertically offset decoys posing as the target, which comprises acquiring one of the targets with a search head, obtaining information concerning the azimuth and elevation of the acquired target from the missile, guiding the missile in elevation, guiding the missile in azimuth, characterized in that the step of guiding the missile in elevation includes guiding the missile along a predetermined path toward the ground level target and the step of guiding the missile in azimuth includes guiding the missile toward the acquired target on the basis of the azimuth information while simulating an elevation flight path toward the acquired target and causing the missile to search for a new target if the simulated flight path departs from the predetermined elevational flight path toward the ground or sea level target.

* * * * *